US011363901B2

(12) United States Patent
St. Cyr

(10) Patent No.: US 11,363,901 B2
(45) Date of Patent: Jun. 21, 2022

(54) MAILBOX SECURITY KIT

(71) Applicant: Brad St. Cyr, Orangevale, CA (US)

(72) Inventor: Brad St. Cyr, Orangevale, CA (US)

( * ) Notice: Subject to any disclaimer, the term of this patent is extended or adjusted under 35 U.S.C. 154(b) by 0 days.

(21) Appl. No.: 17/122,259

(22) Filed: Dec. 15, 2020

(65) Prior Publication Data

US 2021/0212492 A1 Jul. 15, 2021

Related U.S. Application Data

(60) Provisional application No. 62/959,462, filed on Jan. 10, 2020.

(51) Int. Cl.
*A47G 29/124* (2006.01)
*A47G 29/12* (2006.01)

(52) U.S. Cl.
CPC ..... *A47G 29/124* (2013.01); *A47G 29/1209* (2013.01); *A47G 2029/1257* (2017.08)

(58) Field of Classification Search
CPC .. A47G 29/124; A47G 29/20; A47G 29/1209; A47G 2029/1257; E05G 1/04; E05B 65/0075; B65D 55/14; B65D 2251/1083
USPC ..... 232/17, 29, 38, 45; 70/63, 160–162; 109/66–68; 49/68; 220/826
See application file for complete search history.

(56) References Cited

U.S. PATENT DOCUMENTS 755,038 A 3/1904 Palmer
2,945,621 A 7/1960 Kopprasch et al.
4,333,603 A 6/1982 Carlson
4,361,271 A 11/1982 Hester et al.
4,726,512 A * 2/1988 White ..... A47G 29/1209 232/17
5,915,618 A 6/1999 Gaudet
6,520,405 B1 2/2003 Braxter
6,808,108 B1 10/2004 Turnbow et al.
6,929,174 B1 * 8/2005 Ly ..... A47G 29/1209 232/38
7,070,090 B2 7/2006 Ranen
7,175,071 B1 * 2/2007 Slagle ..... A47G 29/16 220/833
7,178,717 B1 * 2/2007 Lindell ..... A47G 29/1209 232/45
7,234,634 B1 * 6/2007 Payne ..... A47G 29/1209 232/45

(Continued)

*Primary Examiner* — William L Miller
(74) *Attorney, Agent, or Firm* — Blue Filament Law PLLC

(57) ABSTRACT

A security access control insert is provided for installation in curbside mailboxes. The security access control insert prevents tampering or theft of delivered mail. The security access control insert may be sold as part of a mailbox, or as a retrofit kit that may be added to a previously installed mailbox. The security access control insert provides a lockable door with a specific supplied access key. A second access key provided to an authorized mail carrier agency or delivery service may be a master key or passkey that is able to open many different customer mailboxes equipped with the security access control insert. The security access control insert may be formed of sheet-metal construction, aluminum, galvanized steel, or may be formed from molded plastic or composite materials. The security access control insert has a shape that matches the interior cross-section of the mailbox to which the insert will be installed.

19 Claims, 9 Drawing Sheets

(56) References Cited

U.S. PATENT DOCUMENTS

| | | | | |
|---|---|---|---|---|
| 7,931,189 | B2 | 4/2011 | Kalenburg | |
| 8,261,965 | B2 | 9/2012 | Cyphers et al. | |
| 8,616,436 | B2 | 12/2013 | Brewer | |
| 10,143,319 | B1 * | 12/2018 | Nichols | A47G 29/1209 |
| 10,624,483 | B2 * | 4/2020 | Tricarico | A47G 29/124 |
| 2004/0238615 | A1 | 12/2004 | Offenbacher | |
| 2006/0065706 | A1 * | 3/2006 | Ranen | A47G 29/1209 232/45 |
| 2008/0035720 | A1 | 2/2008 | Bolles | |
| 2010/0096442 | A1 * | 4/2010 | Kalenburg | A47G 29/12095 232/45 |
| 2010/0237144 | A1 | 9/2010 | Wolfe | |
| 2011/0308042 | A1 * | 12/2011 | Childress | A47G 29/1209 16/277 |
| 2013/0175332 | A1 | 7/2013 | Brewer | |
| 2014/0346221 | A1 | 11/2014 | Pendergast | |
| 2017/0258255 | A1 * | 9/2017 | Clark | A47G 29/1209 |
| 2018/0228390 | A1 | 8/2018 | Cirri et al. | |

* cited by examiner

MAILBOX SECURITY KIT

CROSS REFERENCE TO RELATED APPLICATIONS

This application claims priority benefit of U.S. Provisional Application Ser. No. 62/959,462 filed 10 Jan. 2020, the contents of which are hereby incorporated by reference.

FIELD OF THE INVENTION

The present invention in general relates to mailboxes and in particular, to a kit that provides security for delivered mail left in a mailbox.

BACKGROUND OF THE INVENTION

Mailboxes in more suburban and rural areas are generally located on the curb and are positioned for the mail carrier to insert the mail in an unlocked mailbox. Due to the distances between delivery addresses the mail carrier rides in a delivery vehicle while delivering the mail. The aforementioned mailboxes provide easy access for a mail carrier to deposit a mail delivery without having to exit the vehicle. FIG. 1 is a typical mailbox 100 with an interior collection area 102 with sidewalls 104, and a non-locking door 106. The mailbox 100 may be mounted to a post to raise the mailbox to a convenient level for the mail carrier to make a delivery.

However, easy mail carrier access also generally provides easy access for a person intent on improperly removing or examining the contents of an exposed mailbox. With the recent increases in identity and mail related fraud, the openness and conveniences of the aforementioned mailboxes pose on an ongoing problem.

Thus, there exists a need for improved mail security for delivered mail deposited in curbside mailboxes

SUMMARY OF THE INVENTION

A mailbox security access control insert is provided. The mailbox security access control insert includes an outer frame with a shape that matches an interior cross-section of a mailbox to which the insert will be installed. An access door is hingeably connected to the outer frame by a hinge with an aperture in the access door that accommodates a lock cylinder of a locking mechanism. A lock strike extends from the outer frame to engage with a tongue from the locking mechanism.

A process of improving securing of a mailbox having a non-locking door includes opening the non-locking door to expose a mailbox opening, and retaining an insert of as described above to the opening.

BRIEF DESCRIPTION OF THE DRAWINGS

The subject matter that is regarded as the invention is particularly pointed out and distinctly claimed in the claims at the conclusion of the specification. The foregoing and other objects, features, and advantages of the invention are apparent from the following detailed description taken in conjunction with the accompanying drawings wherein:

DETAILED DESCRIPTION OF THE PREFERRED EMBODIMENTS

The present invention has utility as a security access control insert for installation in curbside mailboxes. Embodiments of the security access control insert prevent tampering or theft of delivered mail. An inventive security access control insert may be sold as part of a mailbox, or as a retrofit kit that may be added to a previously installed mailbox. It should be appreciated that the present invention is not intended to render a mailbox impregnable, but rather deter a casual theft or snooping. In some inventive embodiments, the insert is retro-fit to a conventional mailbox and retained therein without resort to tools.

Embodiments of the security access control insert provide a lockable door with a specific supplied access key. A second access key provided to an authorized mail carrier agency or delivery service may be a master key or passkey that is able to open many different customer mailboxes equipped with the security access control insert. Embodiments of the security access control insert may be formed of sheet-metal construction, aluminum, galvanized steel, or may be formed from molded plastic or composite materials. Embodiments of the security access control insert have a shape that matches the interior cross-section of the mailbox to which the insert will be installed.

Embodiments of the security access control insert may have a set of folding tabs that insert into securing slots in the side walls of the interior collection area of the mailbox. Alternatively, the security access control insert may adhere to the side walls of the interior collection area of the mailbox with glue, two sided-tape, or other fasteners including rivets or screws. Suitable adhesives include, without limitation high strength glue and epoxy adhesives, and tapes coated therewith.

Figure 1:
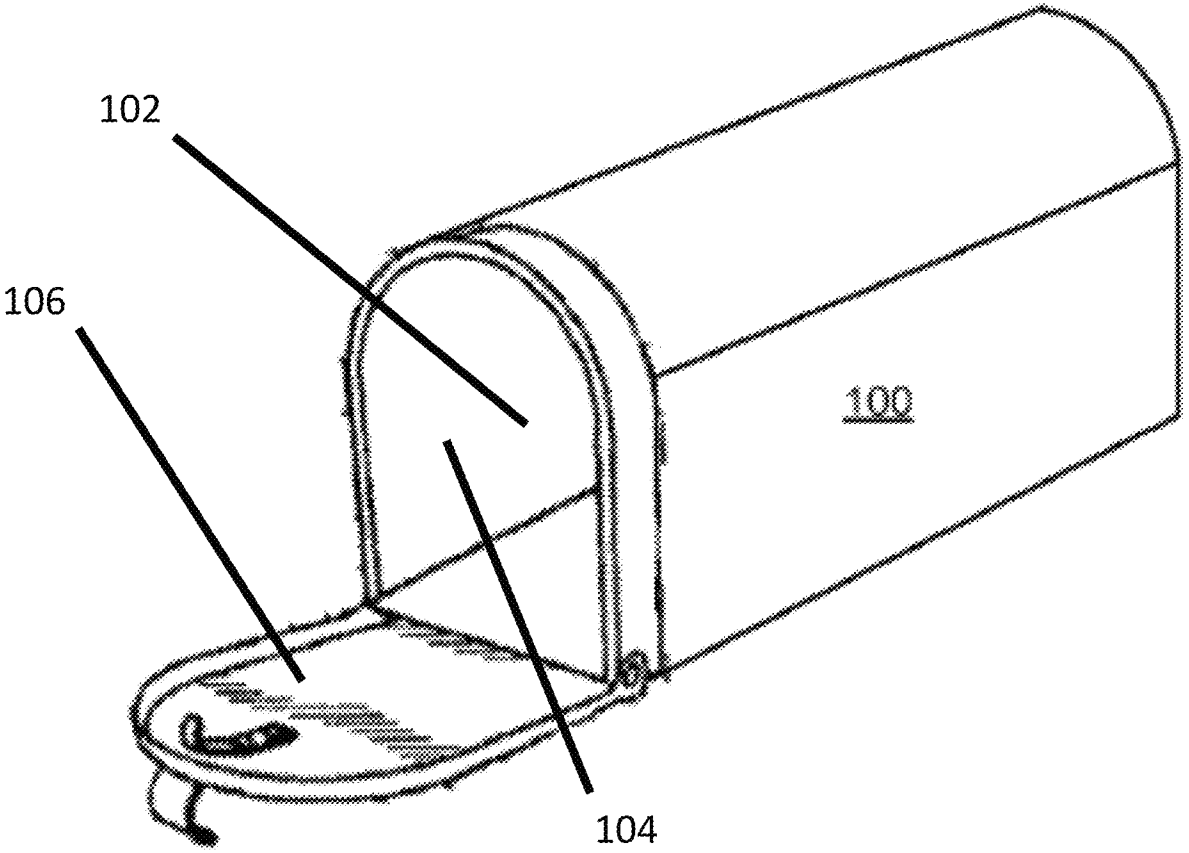
FIG. 1 (Prior Art)
FIG. 1 is a perspective view of a prior art curbside mailbox.
Figure 2:
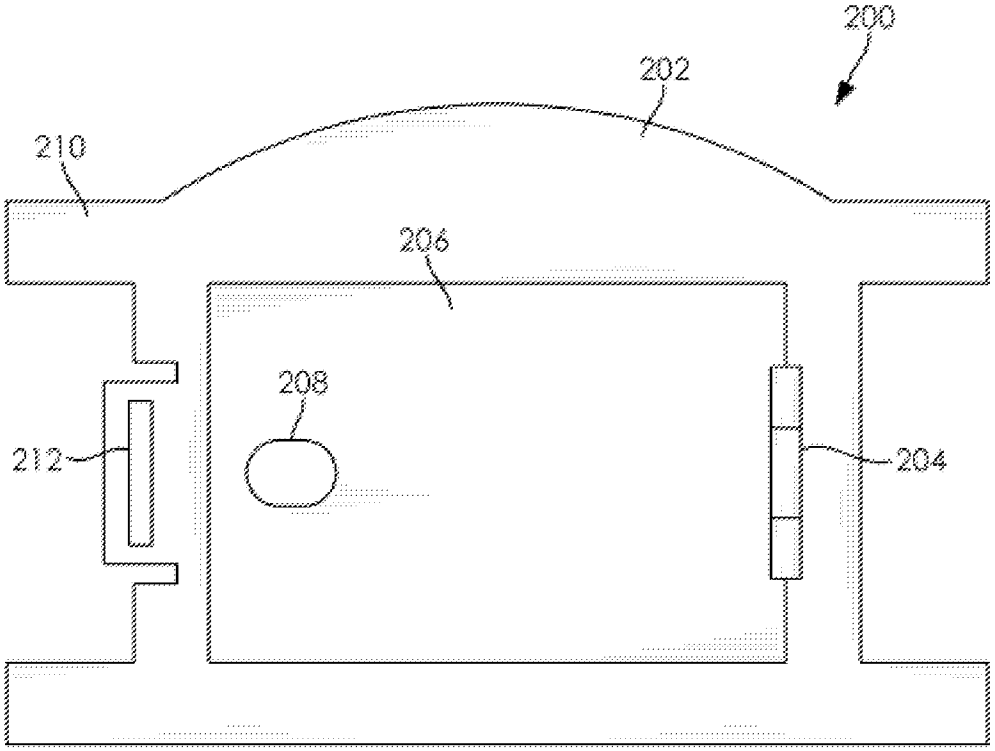
FIG. 2 is a photograph of a security access control insert for installation in the curbside mailbox of FIG. 1 in accordance with embodiments of the invention.
Figure 3:
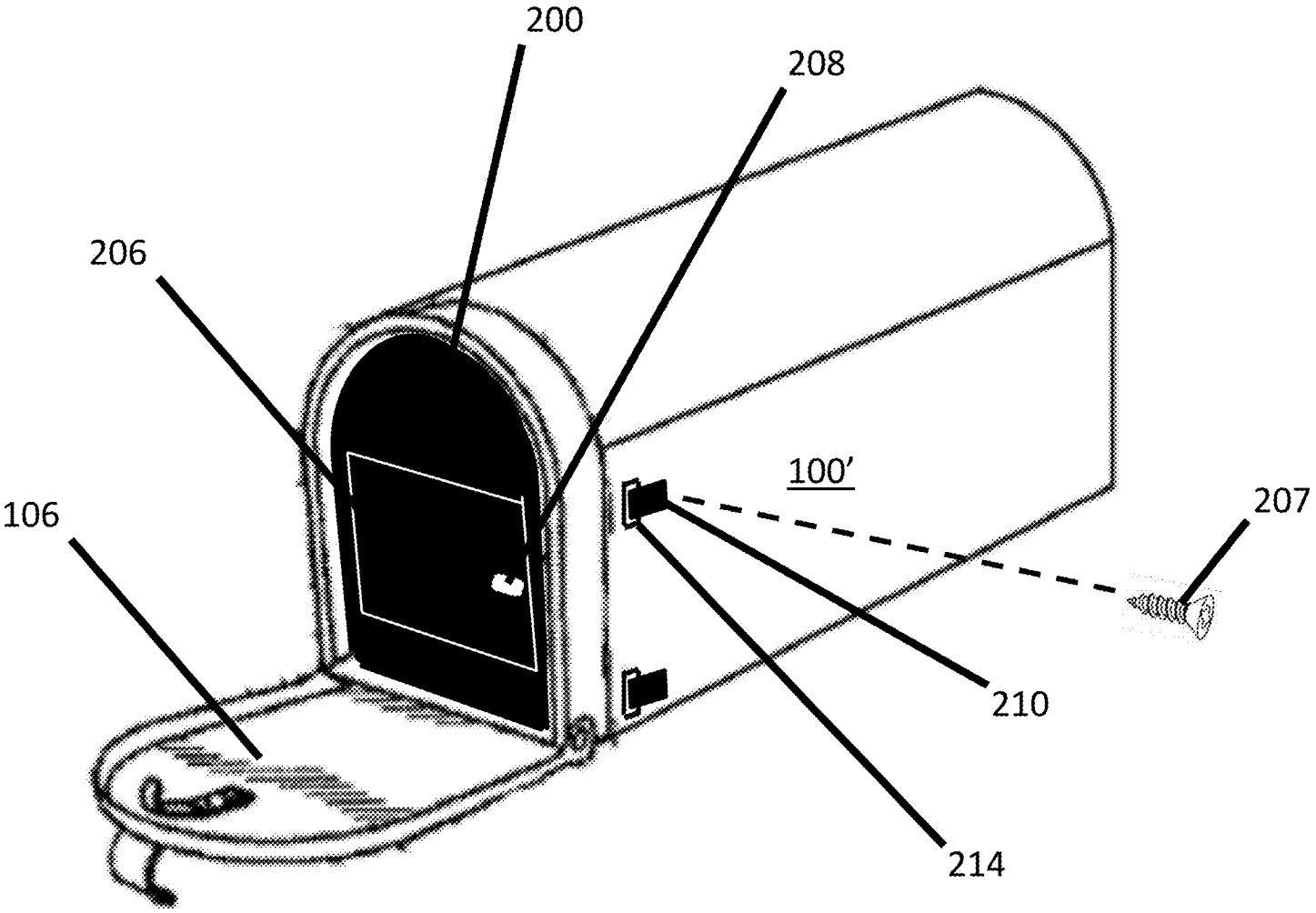
FIG. 3 is a perspective view of a mailbox fitted with the security access control insert in accordance with embodiments of the invention.

Referring now to the figures, FIG. 2 is a photograph of an inventive embodiment of a security access control insert 200 for installation in the curbside mailbox 100' of FIG. 3. The security access control insert 200 has an outer frame 202 that supports a hinge 204 for an access door 206. The hinge 204 hingeably connects the access door 206 to the frame 202 that surrounds access door 206. An aperture 208 in the access door 206 is provided for a lock cylinder of a locking mechanism. A set of tabs 210 may be used to secure the security access control insert 200 to the mailbox 100'. It is appreciated that adhesives may be used to secure the security access control insert 200 to the mailbox 100 in a tool-less manner. A lock strike 212 is attached to the outer frame 202, and is bent at a ninety degree angle when the security access control insert 200 is placed in the mailbox (100, 100').

FIG. 3 is a perspective view of a mailbox 100' fitted with the security access control insert 200. The set of tabs 210 are shown inserted through slots 214 in the side walls 104 and bent inward to attach and secure the security access control insert 200 to the mailbox 100'. As shown the outer non-locking door 106 is opened to expose the security access control insert 200 with the access door 206 in a closed or locked position. In some embodiments, at least one fastener 207 that extends through both the mailbox wall 104 and the tab 210. Exemplary of such fasteners are rivets and sheet metal screws. Such screws in some embodiments have tamperproof heads that cannot be removed with a conventional flat head or Phillips-type screwdriver.

It is appreciated that the set of tabs 210 are also readily bent approximately orthogonal relative to the face of the insert 200 as defined by the access door 206 to create a friction fit within the opening of a conventional mailbox. As a result, a tool-less installation results in some inventive embodiments. In still other embodiments, the set of tabs 210

Figure 4:
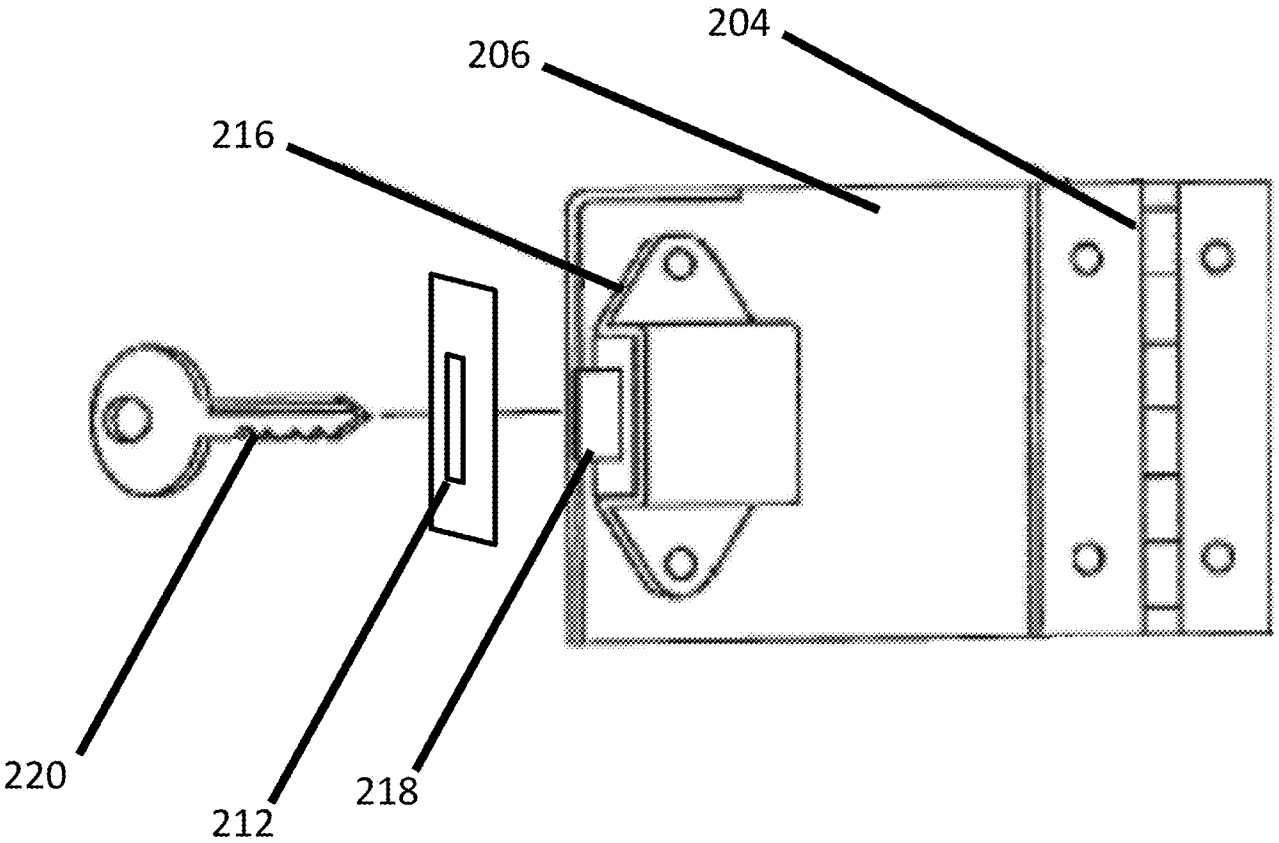
FIG. 4 is a rear view of the door and lock assembly of the security access control insert according to an embodiment of the present invention

FIG. 4 is a rear view of the access door 206 showing an embodiment of a lock assembly 216 of the security access control insert 200. A retractable tongue 218 extends from the lock mechanism 216 and engages the lock strike 212 when the access door 206 is closed. It is appreciated that other types of lock assemblies may be used for the lock mechanism 216 without departing from the scope and spirit of the invention. For example, the lock can either be or have a spring-loaded hasp or a manually operated hasp. An insertable key 220 is operable to open and close the lock.

Figure 5:
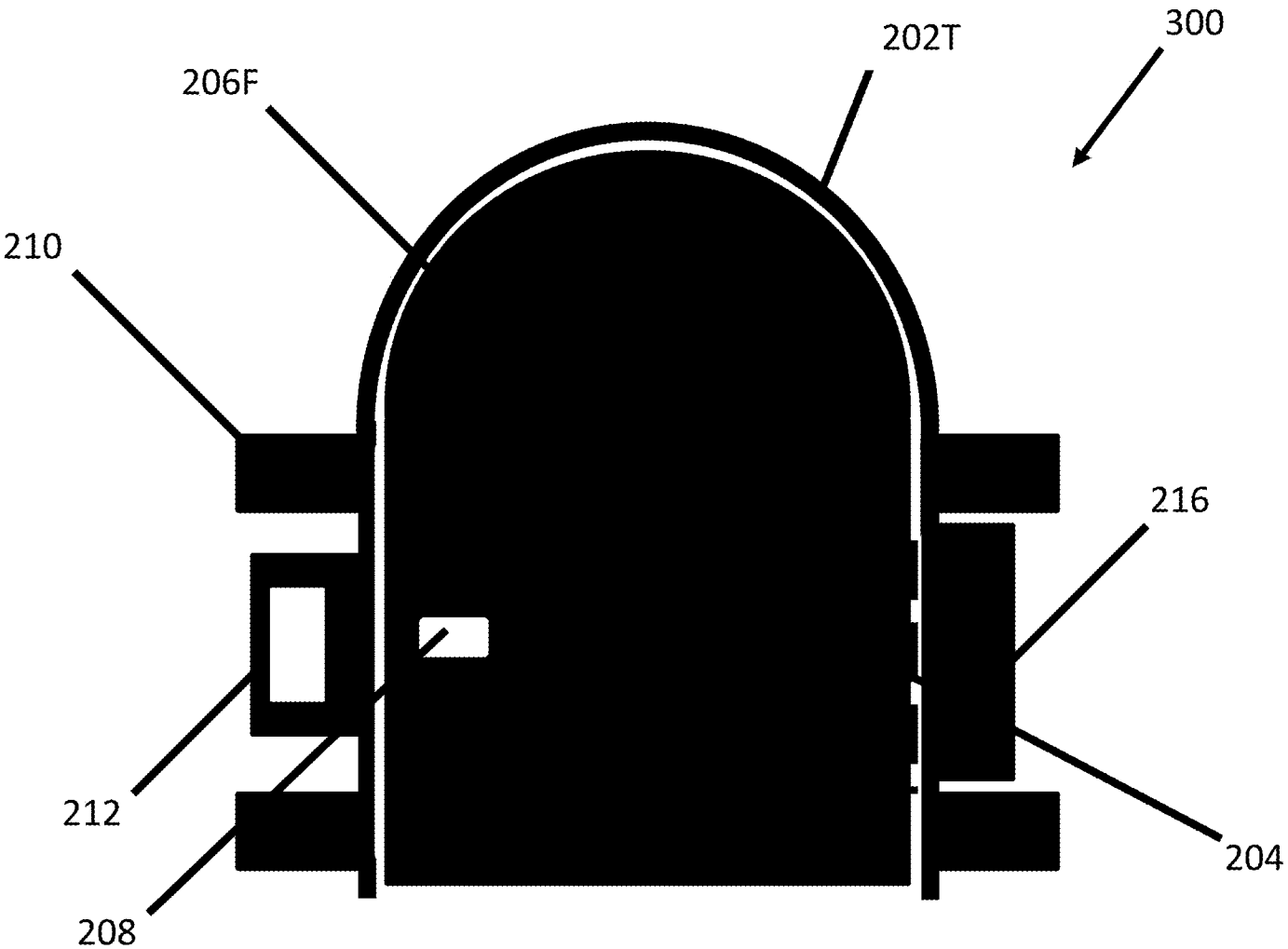
FIG. 5 is a rear view of a thin frame security access control insert in accordance with embodiments of the invention.

FIG. 5 is a rear view of a security access control insert 300 prior to insertion in a mailbox. The security access control insert 300 has an outer thin frame 202T that matches the contours of the interior cross-section of the mailbox to which the insert may be installed. The thin frame 202T provides an almost borderless door frame that allows for a full sized security door 206F that nearly matches the interior cross section of the mailbox. The thin frame 202T supports a hinge 204 for the full sized access door 206F. The hinge 204 hingeably connects the full sized access door 206F to the thin frame 202T that surrounds full sized access door 206F. A hinge mount tab 216 provides a fixed connection point for the hinge 204. The hinge mount tab 216 is bent at a right angle when inserted into the mailbox. An aperture 208 in the full sized access door 206F is provided for a lock cylinder of a locking mechanism. A set of tabs 210 may be used to secure the security access control insert 300 to the mailbox 100'. It is appreciated that adhesives may be used to secure the security access control insert 300 to the mailbox 100 in a tool-less manner. A lock strike 212 is attached to the thin outer frame 202T, and is bent at a ninety degree angle when the security access control insert 300 is placed in the mailbox (100, 100').

Figure 6:
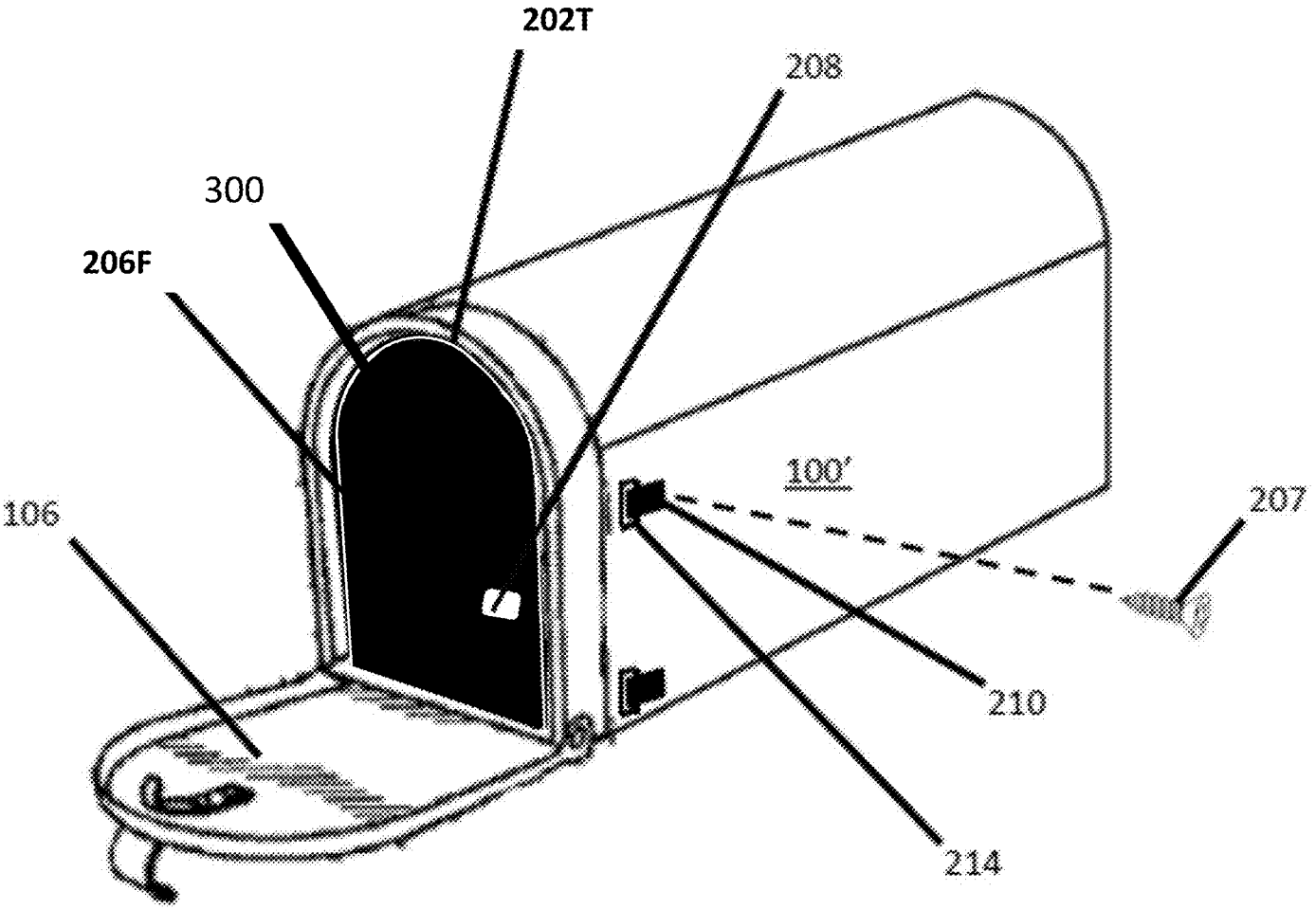
FIG. 6 is a perspective view of a mailbox fitted with the thin frame security access control insert in accordance with embodiments of the invention.

FIG. 6 is a perspective view of a mailbox 100' fitted with the thin frame security access control insert 300. The set of tabs 210 are shown inserted through slots 214 in the side walls 104 and bent inward to attach and secure the security access control insert 200 to the mailbox 100'. As shown the outer non-locking door 106 is opened to expose the security access control insert 200 with the full sized access door 206F in a closed or locked position. In some embodiments, at least one fastener 207 that extends through both the mailbox wall and the tab. Exemplary of such fasteners are rivets and sheet metal screws. Such screws in some embodiments may have tamperproof heads that cannot be removed with a conventional flat head or Phillips-type screwdriver.

Figure 7:
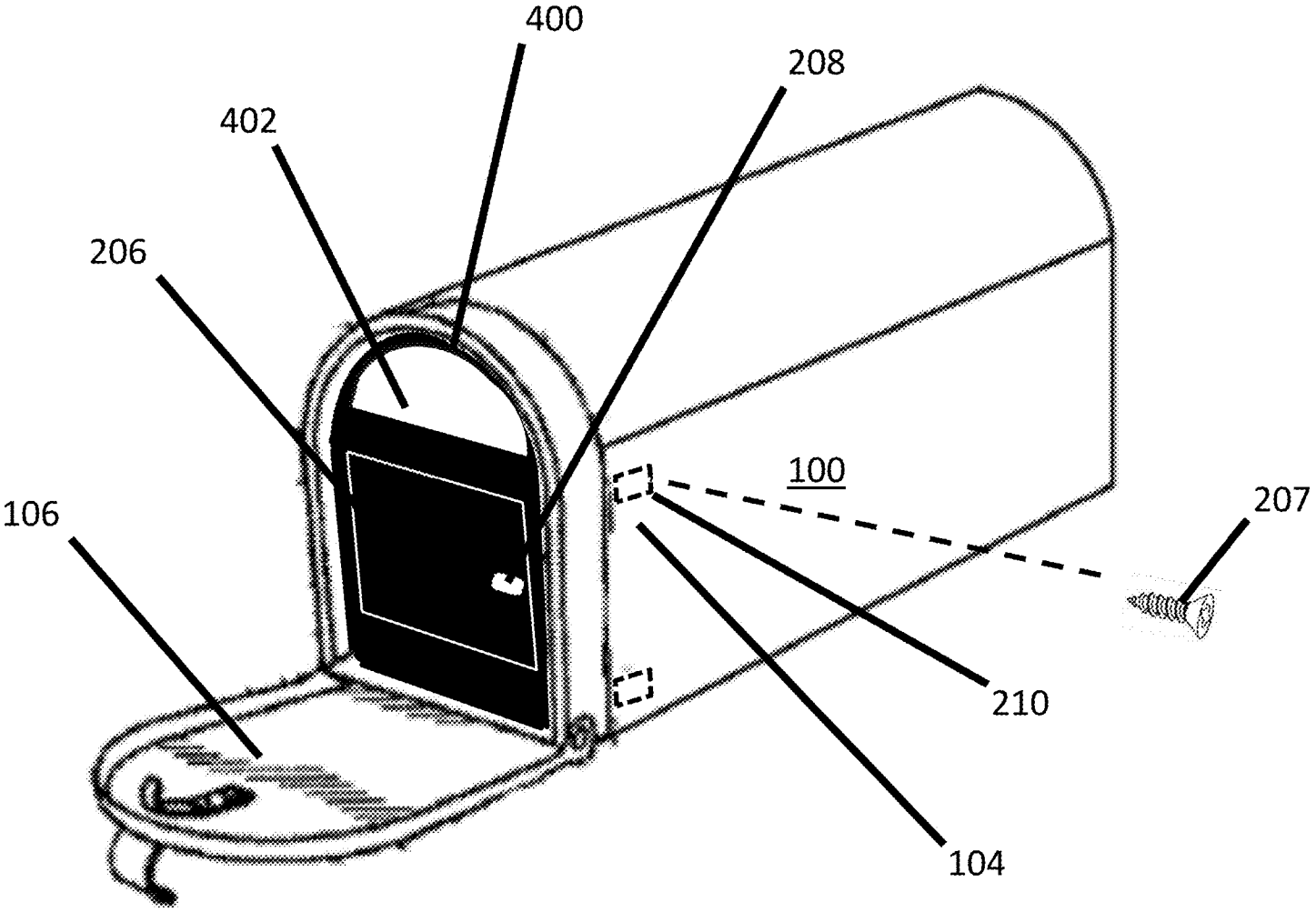
FIG. 7 is a perspective view of a mailbox fitted with of an additional embodiment of a thin frame security access control insert in accordance with embodiments of the invention.

FIG. 7 is a perspective view of a mailbox 100 fitted with the security access control insert 400. The set of tabs 210 are shown as dotted lines that are connected to or adhered to the interior of the side walls 104 and bent inward to attach and secure the security access control insert 400 to the mailbox 100. As shown the outer non-locking door 106 is opened to expose the security access control insert 400 with the access door 206 in a closed or locked position. A mail slot 402 sized smaller then a person's hand allows for mail to be inserted while also preventing someone to remove mail once inserted through the mail slot 402. In some embodiments, at least one fastener 207 that extends through both the mailbox wall 104 and the tab 210. Exemplary of such fasteners are rivets and sheet metal screws. Such screws in some embodiments may have tamperproof heads that cannot be removed with a conventional flat head or Phillips-type screwdriver.

Figure 8:
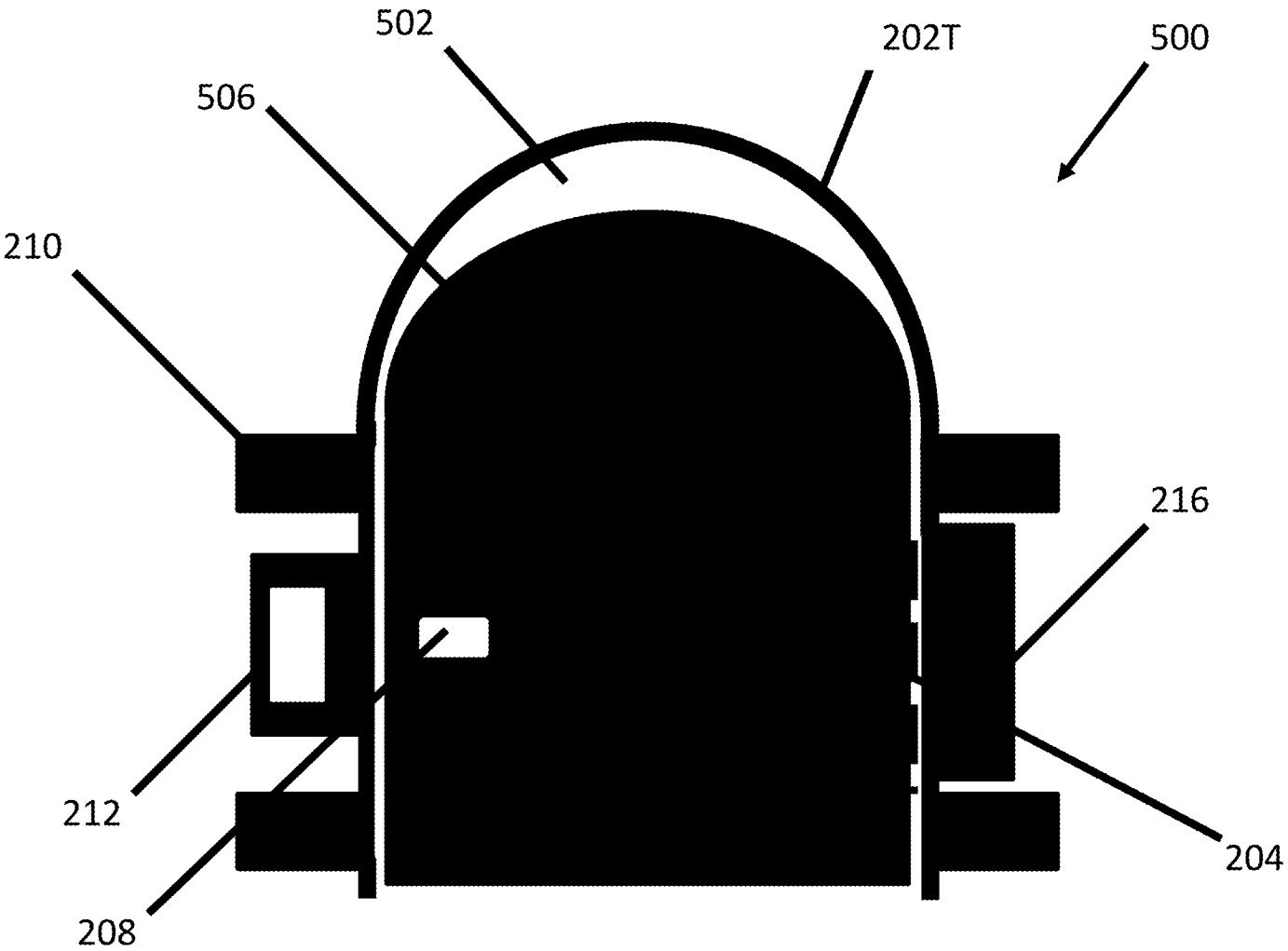
FIG. 8 is a rear view of a thin frame security access control insert with a crescent shaped opening for mail insertion in accordance with embodiments of the invention.

FIG. 8 is a rear view of a security access control insert 500 prior to insertion in a mailbox. The security access control insert 500 has an outer thin frame 202T that matches the contours of the interior cross-section of the mailbox to which the insert may be installed. The thin frame 202T provides an almost borderless door frame for a security door 506 that closely matches the interior cross section of the mailbox. The slot 502 has a crescent like shape that is formed by the gap between the security door 506 and the thin frame 202T. The slot 502 allows for the insertion of mail, but is dimensioned so as to not allow a hand to be inserted into the interior of the mailbox. The thin frame 202T supports a hinge 204 for the access door 506. The hinge 204 hingeably connects the access door 506 to the thin frame 202T that surrounds the access door 506. A hinge mount tab 216 provides a fixed connection point for the hinge 204. The hinge mount tab 216 is bent at a right angle when inserted into the mailbox. An aperture 208 in the access door is provided for a lock cylinder of a locking mechanism. A set of tabs 210 may be used to secure the security access control insert 500 to the mailbox 100'. It is appreciated that adhesives may be used to secure the security access control insert 300 to the mailbox 100 in a tool-less manner. A lock strike 212 is attached to the thin outer frame 202T, and is bent at a ninety degree angle when the security access control insert 500 is placed in the mailbox (100, 100').

It is appreciated that the set of tabs 210 are also readily bent approximately orthogonal relative to the face of the insert 500 as defined by the access door 506 to create a friction fit within the opening of a conventional mailbox. As a result, a tool-less installation results in some inventive embodiments. In still other embodiments, the set of tabs 210 are adhered to the mailbox walls 104. The security access control insert 500 may adhere to the side walls of the interior collection area and walls 104 of the mailbox with glue or two sided-tape. Suitable adhesives include, without limitation high strength glue and epoxy adhesives, and tapes coated therewith. The adhesive may be applied to the tabs 210 and/or around the perimeter of insert 500.

Figure 9:
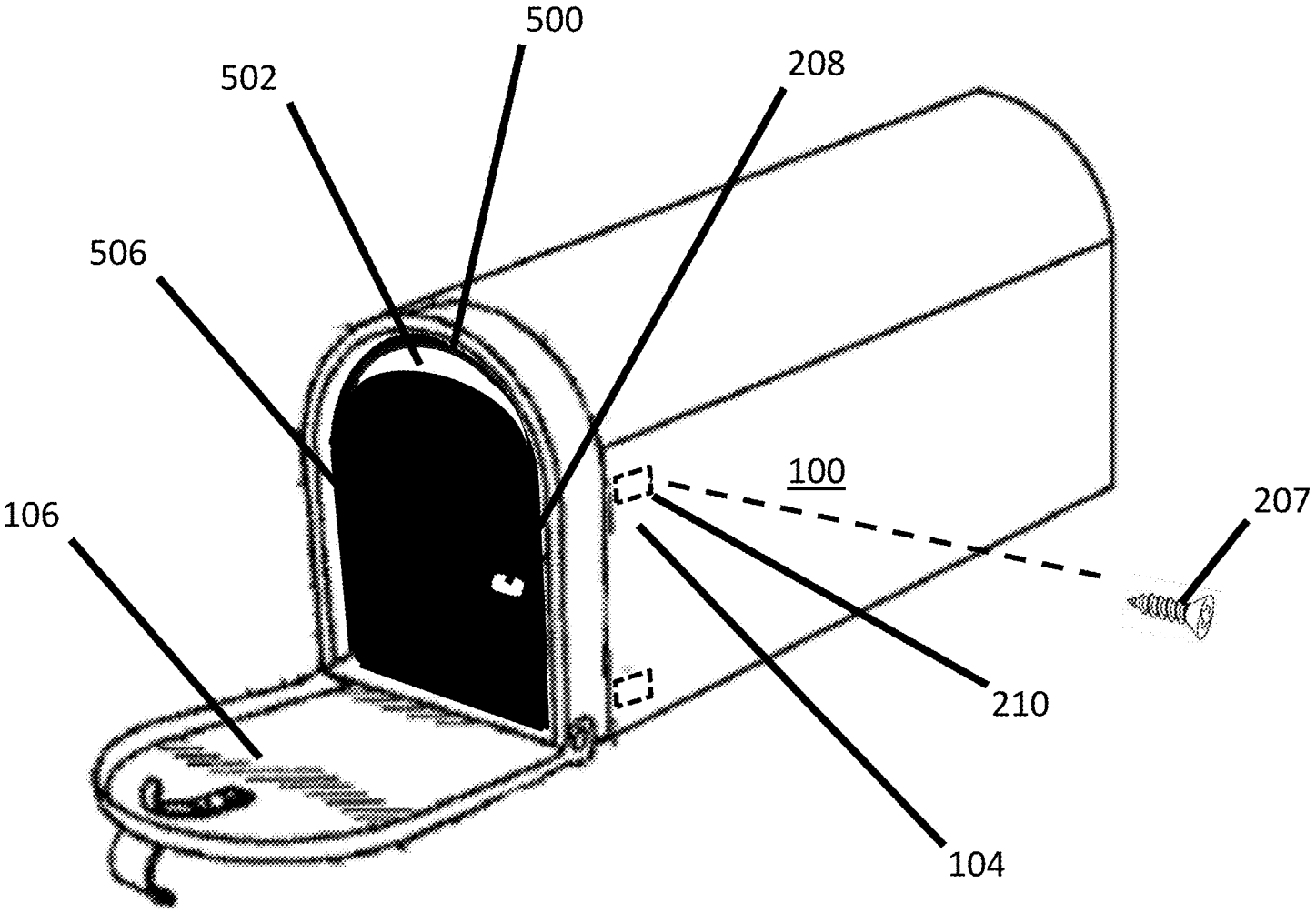
FIG. 9 is a perspective view of a mailbox fitted with the embodiment of a thin frame security access control insert of FIG. 8 in accordance with embodiments of the invention.

FIG. 9 is a perspective view of a mailbox 100 fitted with the security access control insert 500. The set of tabs 210 are shown as dotted lines that are connected to or adhered to the interior of the side walls 104 and bent inward to attach and secure the security access control insert 500 to the mailbox 100. As shown the outer non-locking door 106 is opened to expose the security access control insert 500 in a closed or locked position. A mail slot 502 is sized smaller then a person's hand, and allows for mail to be inserted while also preventing someone to remove mail once inserted through the mail slot 502. In some embodiments, at least one fastener 207 that extends through both the mailbox wall 104 and the tab 210. Exemplary of such fasteners are rivets and sheet metal screws. Such screws in some embodiments may have tamperproof heads that cannot be removed with a conventional flat head or Phillips-type screwdriver.

As a person skilled in the art will recognize from the previous detailed description and from the figures and claims, modifications and changes can be made to the preferred embodiments of the invention without departing from the scope of this invention defined in the following claims.

The invention claimed is:

1. A mailbox security access control insert, said insert comprising:

an outer frame with a shape that matches an interior cross-section of a mailbox to which the insert will be installed;

an access door hingeably connected to said outer frame by a hinge;

an aperture in said access door that accommodates a lock cylinder of a locking mechanism; and a lock strike extending from said outer frame;

wherein said outer frame and said lock strike are initially provided in a planar arrangement, with said lock strike configured to be bent to a ninety degree angle relative to said outer frame when said insert is placed in the mailbox.

2. The insert of claim 1 wherein said outer frame further comprises a set of tabs.

3. The insert of claim 2 wherein said set of tabs engage corresponding slots in the mailbox.

4. The insert of claim 2 wherein said set of tabs friction fit against an inner surface of a wall of the mailbox.

5. The insert of claim 2 further comprising a fastener, the fastener comprising a rivet or a screw simultaneously penetrating a wall of the mailbox and a tab of said set of tabs.

6. The insert of claim 2 wherein said outer frame and said set of tabs are initially provided in a planar arrangement, with said set of tabs configured to be bent orthogonal relative to said outer frame when said insert is placed in the mailbox.

7. The insert of claim 1 further comprising an adhesive retaining said insert in contact with the mailbox.

8. The insert of claim 1 further comprising an open mail slot for insertion of mail.

9. The insert of claim 8 wherein said open mail slot is provided directly below said outer frame.

10. The insert of claim 1 wherein said locking mechanism further comprises a retractable tongue that engages said lock strike when said access door is closed.

11. The insert of claim 1 further comprising a first key that controls said locking mechanism, and a master key that controls a plurality of said locking mechanisms that are a part of a plurality of said mailbox security access control inserts.

12. The insert of claim 1 wherein said mailbox security access control insert is formed of one of sheet-metal construction, aluminum, or galvanized steel.

13. The insert of claim 1 wherein said mailbox security access control insert is formed from molded plastic or composite materials.

14. The insert of claim 1 wherein said mailbox security access control insert is adhered to interior sidewalls of the mailbox with glue or two sided-tape.

15. The insert of claim 1 wherein said outer frame is a thin frame that provides an almost borderless door frame that allows said access door to be a full sized access door that nearly matches the interior cross section of the mailbox.

16. A process of using the insert of claim 1, the process improving securing of the mailbox having a non-locking door comprising:

opening the non-locking door to expose a mailbox opening;

retaining the insert to the opening.

17. The process of claim 16 wherein retaining the insert is done without tools.

18. The process of claim 16 wherein retaining the insert is with a liquid adhesive or an adhesive tape.

19. The process of claim 16 wherein retaining the insert is with friction fit tabs.

* * * * *